US009714394B2

(12) United States Patent
Kinoshita et al.

(10) Patent No.: US 9,714,394 B2
(45) Date of Patent: Jul. 25, 2017

(54) METHOD FOR PRODUCING ASHLESS COAL

(71) Applicant: KOBE STEEL, LTD., Kobe-shi (JP)

(72) Inventors: Shigeru Kinoshita, Hyogo (JP); Noriyuki Okuyama, Hyogo (JP); Takuya Yoshida, Hyogo (JP); Koji Sakai, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 30 days.

(21) Appl. No.: 14/770,685

(22) PCT Filed: Mar. 17, 2014

(86) PCT No.: PCT/JP2014/057203

§ 371 (c)(1),
(2) Date: Aug. 26, 2015

(87) PCT Pub. No.: WO2014/156789

PCT Pub. Date: Oct. 2, 2014

(65) Prior Publication Data

US 2016/0010011 A1 Jan. 14, 2016

(30) Foreign Application Priority Data

Mar. 28, 2013 (JP) ..... 2013-069124

(51) Int. Cl.
*C10L 5/00* (2006.01)
*C10L 5/04* (2006.01)
(Continued)

(52) U.S. Cl.
CPC ..... *C10L 5/04* (2013.01); *C10L 1/322* (2013.01); *C10L 9/00* (2013.01); *C10L 2290/02* (2013.01);
(Continued)

(58) Field of Classification Search
CPC ... B29C 43/00; B29C 43/52; B29C 2043/522; B29C 2043/043; B29C 2035/1616;
(Continued)

(56) References Cited

U.S. PATENT DOCUMENTS 4,397,653 A * 8/1983 Longanbach ..... C10L 1/322 208/427
2010/0006477 A1* 1/2010 Okuyama ..... C10L 9/10 208/428
(Continued)

FOREIGN PATENT DOCUMENTS

CN 101070495 A 11/2007
CN 102851099 A 1/2013
(Continued)

OTHER PUBLICATIONS

International Search Report issued May 13, 2014 in PCT/JP2014/057203 (with English language translation).
Written Opinion issued May 13, 2014 in PCT/JP2014/057203 (with English language translation).

*Primary Examiner* — Pamela H Weiss
(74) *Attorney, Agent, or Firm* — Oblon, McClelland, Maier & Neustadt, L.L.P.

(57) ABSTRACT

A method for producing an ashless coal includes a slurry preparation, an extraction, a separation, an ashless coal acquirement, and a by-product acquirement. In the by-product acquirement, a solvent used in the slurry preparation is evaporated and separated from a solid-content concentrated liquid separated in the separation, and then, a by-product coal is acquired. The by-product coal is used as a fuel for heating a slurry obtained in the slurry preparation.

3 Claims, 1 Drawing Sheet

(51) Int. Cl.
*C10L 9/08* (2006.01)
*C10L 1/32* (2006.01)
*C10L 9/00* (2006.01)

(52) U.S. Cl.
CPC ..... *C10L 2290/06* (2013.01); *C10L 2290/08* (2013.01); *C10L 2290/10* (2013.01); *C10L 2290/24* (2013.01); *C10L 2290/54* (2013.01); *C10L 2290/544* (2013.01); *C10L 2290/547* (2013.01)

(58) Field of Classification Search
CPC ..... B29C 2043/527; B30B 9/328; Y10S 100/905; Y10S 100/906; Y10S 100/908; C10L 5/04; C10L 9/00; C10L 1/322; C10L 2290/02; C10L 2290/06; C10L 2290/547; C10L 2290/10; C10L 2290/08; C10L 2290/544; C10L 2290/54; C10L 2290/24
USPC ..... 264/109
See application file for complete search history.

(56) References Cited

U.S. PATENT DOCUMENTS

| | | | | |
|---|---|---|---|---|
| 2011/0041393 | A1* | 2/2011 | Sugita | C10L 5/00 44/626 |
| 2012/0291342 | A1* | 11/2012 | Sugita | C10L 5/08 44/594 |
| 2015/0013215 | A1 | 1/2015 | Sakai et al. | |

FOREIGN PATENT DOCUMENTS

| | | | | |
|---|---|---|---|---|
| JP | 4061351 | B1 | 3/2008 | |
| JP | 2009-126951 | A | 6/2009 | |
| JP | 2009-215401 | A | 9/2009 | |
| JP | 2009215401 | A * | 9/2009 | |
| JP | 2009-227718 | A | 10/2009 | |
| JP | WO 2010044376 | A1 * | 4/2010 | C10L 5/08 |
| JP | 2013-95828 | A | 5/2013 | |
| JP | 2013-155364 | A | 8/2013 | |

* cited by examiner

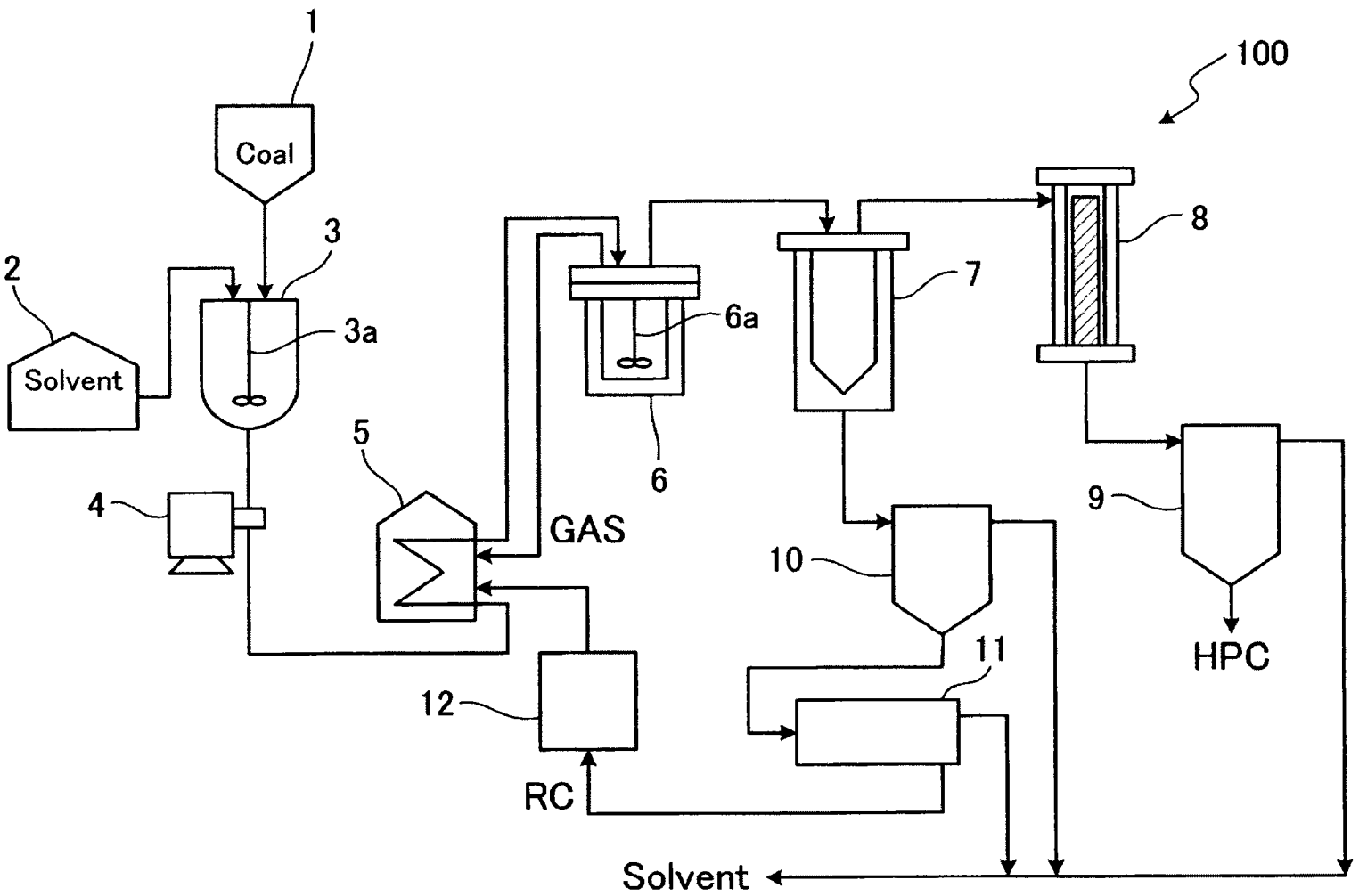
100
8
9
HPC
7
11
10
6a
6
GAS
Solvent
RC
12
5
3
3a
1
Coal
4
2
Solvent

METHOD FOR PRODUCING ASHLESS COAL

TECHNICAL FIELD

The present invention relates to a method for producing an ashless coal, for obtaining an ashless coal in which ash components have been removed from a coal.

BACKGROUND ART

A method for producing an ashless coal is disclosed in Patent Document 1. In such a production method, a raw material coal as a mixture of steam coal and caking coal is mixed with a solvent to prepare a slurry, and the slurry thus prepared is heated, thereby extracting coal components soluble in the solvent, then the gravitational settling method is applied to the slurry in which the coal components has been extracted, thereby separating the slurry into a solution which contains the coal components soluble in the solvent and a solid-content concentrated liquid containing coal components insoluble in the solvent, and further the removal of the solvent from the separated solution is carried out, thereby obtaining an ashless coal.

PRIOR ART DOCUMENT

Patent Documents

Patent Document 1: JP-A-2009-227718

SUMMARY OF THE INVENTION

Problem that the Invention is to Solve

In the process for producing an ashless coal, in addition to an ashless coal as the final product, a by-product coal is produced as a by-product. This by-product coal has high ash component concentration as compared with an ashless coal and a coking coal, and therefore, its commercial value as a fuel is inferior to an ashless coal.

Furthermore, in the process for producing an ashless coal, the means for heating a slurry is necessary. An electric heater, a heating medium heater, an induction heat transfer type heating furnace, a gas burning heating furnace, an oil burning heating furnace and the like are known as a general fluid heating means.

However, an electric heating and a heating medium heater are not suitable for a production process of an ashless coal and large capacity heating. Furthermore, an induction heat transfer type heating furnace involves high equipment cost, and is hard to apply to large capacity heating. In this respect, a gas burning heating furnace and an oil burning heating furnace are suitable for a production process of an ashless coal and large capacity heating, but have the problem that a fuel cost is increased.

An object of the present invention is to provide a method for producing an ashless coal, capable of reducing running cost required in the production of an ashless coal.

Means for Solving the Problems

A method for producing an ashless coal according to the present invention includes: a slurry preparation step of mixing a coal and a solvent, thereby acquiring a slurry; an extraction step of heating the slurry, thereby extracting a coal component soluble in the solvent; a separation step of separating the slurry which has been obtained in the extraction step into a solution in which the coal component soluble in the solvent is dissolved and a solid-content concentrated liquid in which a coal component insoluble in the solvent is concentrated; an ashless coal acquirement step of evaporating and separating the solvent from the solution which has been separated in the separation step, thereby acquiring an ashless coal; and a by-product acquirement step of evaporating and separating the solvent from the solid-content concentrated liquid which has been separated in the separation step, thereby acquiring a by-product coal, wherein the by-product coal is used as a fuel for heating the slurry which has been obtained in the slurry preparation step.

Advantageous Effects of the Invention

According to the method for producing an ashless coal in the present invention, running cost required in the production of an ashless coal can be reduced.

BRIEF DESCRIPTION OF THE DRAWING

FIG. 1 is a schematic diagram of an ashless coal production equipment.

EMBODIMENTS FOR CARRYING OUT THE INVENTION

In the following, an exemplary embodiment for carrying out the present invention is illustrated in detail by reference to the drawing.

(Method for Producing Ash less Coal)

As shown in FIG. 1, an ashless coal production equipment 100 to be used in the method for producing an ashless coal according to the present embodiment includes, in the order of from the upstream side of the production process of an ashless coal (HPC), a coal hopper 1, a solvent tank 2, a slurry preparation tank 3, a transport pump 4, a preheater 5, an extraction tank 6, a gravitational settling tank 7, a filter unit 8, solvent separators 9 and 10, a dryer 11, and a humidifier 12.

The method for producing an ashless coal includes a slurry preparation step, an extraction step, a separation step, an ashless coal acquirement step and a by-product coal acquirement step. Each of these steps is explained below. Additionally, a coal to be used as a raw material in the present production method has no particular restriction, and bituminous coal high in extraction rate may be used or low rank coal low in price (such as subbituminous coal or brown coal) may be used. Herein, the term "ashless coal" refers to a coal having an ash content of 5 wt % or less, preferably 3 wt % or less.

(Slurry Preparation Step)

The slurry preparation step is a step of preparing a slurry by mixing a coal and a solvent. This slurry preparation step is performed in the slurry preparation tank 3 in FIG. 1. The coal as a raw material is added to the slurry preparation tank 3 from the coal hopper 1, and a solvent is added to the slurry preparation tank 3 from the solvent tank 2. The coal and solvent which are added to the slurry preparation tank 3 are mixed by the stirrer 3*a*, thereby forming into a slurry composed of the coal and the solvent.

The mixing proportion of the coals to the solvent is e.g. from 10 to 50 wt %, preferably from 20 to 35 wt %, on a dried coal basis.

(Extraction Step)

The extraction step is a step of extracting coal components soluble in the solvent (a step of dissolving such components in the solvent) by heating the slurry obtained in the slurry preparation step. This extraction step is performed in the preheater 5 and the extraction tank 6 in FIG. 1. This extraction step includes a preheating stage heating the slurry by the preheater 5. The slurry which has been prepared in the slurry preparation tank 3 is fed to the preheater 5 by means of the transport pump 4, heated up to a predetermined temperature, then fed to the extraction tank 6, and further kept at a predetermined temperature while stirring by a stirrer 6*a*. In this way, the extraction is performed. In the extraction tank 6, a gas is generated in extracting coal components soluble in the solvent. This gas includes $CH_4$, $C_2H_4$, $C_2H_6$, $C_3H_8$, $C_4H_{10}$, $H_2$, CO and the like, and has high calorie of about 8000 kcal/kg. Therefore, this gas is used in a fuel of the preheater 5 as a supplemental fuel of a by-product coal described hereinafter.

In a case of extracting coal components soluble in the solvent by heating the slurry prepared by mixing the coal with the solvent, a solvent in which the coal is highly soluble, more specifically an aromatic solvent (a hydrogen donative solvent or a hydrogen nondonative solvent) in many cases, is mixed with a coal, and by heating the resulting mixture, organic components in the coal are extracted.

The hydrogen nondonative solvent is a coal-derived solvent obtained mainly by refining carbonization products of coal and predominantly composed of bicyclic aromatic compounds. Because such a hydrogen nondonative solvent is stable even under conditions of heating and has a high affinity for coal, the proportion of soluble components (coal components) extracted with the solvent (hereafter referred to as the extraction rate, too) is high, and the solvent can be easily recovered by the methods such as distillation. Main ingredients in the hydrogen nondonative solvent are bicyclic aromatic compounds such as naphthalene, methylnaphthalene, dimethylnaphthalene or trimethylnaphthalene. As the other ingredients in the hydrogen nondonative solvent, examples thereof include a naphthalene, a anthracene and a fluorine, which each have aliphatic side chains, and further include biphenyl and an alkylbenzene having long-chain aliphatic side chains.

Although the case of using a hydrogen nondonative compound as the solvent is described in the above explanation, it goes without saying that any of hydrogen donative compounds (including the case of coal liquefied oil), typified by tetralin, can be used as the solvent. The use of a hydrogen donative solvent brings about enhancement of ashless coal yield.

Additionally, the solvent has no particular restriction as to its boiling temperature. From the viewpoints of pressure reductions in the extraction step and separation step, an extraction rate in the extraction step, a solvent recovery rate in the ashless coal acquirement step and the like, solvents having boiling temperatures in a range of 180° C. to 300° C., especially 240° C. to 280° C., can be used favorably.

The heating temperature of the slurry in the extraction step has no particular limitations so long as dissolution of solvent-soluble components can be achieved. From the viewpoint of ensuring thorough dissolution of solvent-soluble components and improvement in extraction rate, the heating temperature is e.g. from 300° C. to 420° C., preferably 360° C. to 400° C.

The heating time (extraction time) also has no particular limitations, but from the viewpoint of ensuring thorough dissolution and improvement in extraction rate, the heating time is e.g. from 10 to 60 minutes. Herein, the term "heating time" refers to the sum of the heating time in the preheater 5 in FIG. 1 and the heating time in the extraction tank 6 in FIG. 1.

The extraction step is carried out in the presence of an inert gas such as nitrogen. The suitable pressure inside the extraction tank 6 is e.g. from 1.0 to 2.0 MPa, though it depends on the temperature during the extraction and the vapor pressure of a solvent to be used. When the pressure inside the extraction tank 6 is lower than the vapor pressure of the solvent, the solvent vaporizes and the solvent cannot be confined within the liquid phase, and the extraction ends in failure. In order to confine the solvent within the liquid phase, pressure higher than the vapor pressure of the solvent is therefore necessary. On the other hand, when the pressure is too high, it brings about increases in costs of equipment and operation, and it is therefore uneconomical.

(Separation Step)

The separation step is a step of separating the slurry which has been obtained in the extraction step into a solution in which coal components soluble in the solvent are dissolved and a solid-content concentrated liquid (solvent-insoluble component concentrated liquid) which contains coal components insoluble in the solvent (solvent-insoluble components such as ash components) in a concentrated state, by the gravitational settling method. This separation step is carried out in the gravitational settling tank 7 in FIG. 1. In the gravitational settling tank 7, the slurry which has been obtained in the extraction step is separated into supernatant liquor as the solution and the solid-content concentrated liquid by dint of gravity. The supernatant liquor in the upper part of the gravitational settling tank 7 is discharged into the solvent separator 9, if necessary, by way of the filter unit 8, and simultaneously, the solid-content concentrated liquid settled in the lower part of the gravitational settling tank 7 is discharged into the solvent separator 10.

The gravitational settling method is a method of holding the slurry in the tank, and settling and separating the solvent-insoluble components by exploiting gravity. The solvent-insoluble components (e.g. ash components) having a specific gravity larger than that of the solution in which coal components soluble in the solvent are dissolved, settle in the lower part of the gravitational settling tank 7 by the force of gravity. By continuously discharging the supernatant liquor from the upper part of the tank and the solid-content concentrated liquid from the lower part of the tank while continuously feeding the slurry into the tank, continuous separation treatment becomes possible.

For prevention of reprecipitation of solvent-soluble components eluted from the coal, it is appropriate that the inside of the gravitational settling tank 7 be kept warm (or in a heated state) or be left pressurized. The warming (heating) temperature is e.g. from 300° C. to 380° C., and the pressure inside the tank is e.g. from 1.0 MPa to 3.0 MPa.

In addition to the gravitational settling method, examples of methods for separating the solution which contains coal components dissolved in the solvent from the slurry which has been obtained in the extraction step include a filtration method, a centrifugal separation method and the like.

(Ashless Coal Acquirement Step)

The ashless coal acquirement step is a step of acquiring an ashless coal (HPC) through the evaporative separation of the solvent from the solution (supernatant liquor) which has been separated in the separation step. This ashless coal acquirement step is carried out in the solvent separator 9 in FIG. 1. After the filtration in the filter unit 8, the solution which has been separated in the gravitational settling tank 7 is fed to the solvent separator 9, and in the solvent separator 9, the solvent is evaporated and separated from the supernatant liquor. The evaporative separation of the solvent from the solution is preferably carried out in the presence of an inert gas such as nitrogen. In the present embodiment, the solvent is evaporated and separated from the solution in an atmosphere of nitrogen gas introduced into the solvent separator 9.

As the method for separating the solvent from the solution (supernatant liquor), a common distillation or evaporation method or the like can be used. The solvent which has been separated in the solvent separator 9 is returned to the solvent tank 2, and is used in cycles. Circulating use of the solvent is preferable, but not essential (which is also applicable to the by-product coal acquirement step mentioned later). By separating the solvent from the supernatant liquor, an ashless coal (HPC) containing substantially no ash components can be obtained.

The ashless coal contains almost no ash components, is absolutely free of moisture, and offers a calorific value higher than a raw material coal. In addition, the ashless coal has an extensive improvement in coal plastic properties (flowability) which are especially important for a raw material of steelmaking coke, and even when the raw material coal has no plastic properties, the ashless coal (HPC) obtained from it has excellent plastic properties. Accordingly, the ashless coal can be used e.g. in a coal blend as a raw material for making coke. Further, the ashless coal almost free of ash components has high combustion efficiency and can reduce the amount of ashes produced. Attention is therefore being given to the use of ashless coal as a gas turbine direct-injection fuel in a high-efficiency, combined-cycle generation system utilizing gas turbine combustion.

(By-Product Coal Acquirement Step)

The by-product coal acquirement step is a step of evaporating and separating the solvent from the solid-content concentrated liquid which has been separated in the separation step, thereby acquiring a by-product coal. This by-product coal acquirement step includes a by-product coal mixture acquirement step and a by-product coal drying step.

(By-Product Coal Mixture Acquirement Step)

The by-product coal mixture acquirement step is a step of evaporating and separating the solvent from the solid-content concentrated liquid which has been separated in the separation step, thereby acquiring a by-product coal mixture containing a by-product in which the solvent remains. This by-product coal mixture acquirement step is carried out in the solvent separator 10 in FIG. 1. The solid-content concentrated liquid which has been separated by the gravitational settling tank 7 is fed to the solvent separator 10, and the solvent is evaporated and separated from the solid-content concentrated liquid in the solvent separator 10. The evaporative separation of the solvent from the solid-content concentrated liquid is preferably performed in the presence of an inert gas such as nitrogen. In the present embodiment, the solvent is evaporated and separated from the solid-content concentrated liquid in nitrogen gas which has been introduced in the solvent separator 10.

As the method for separating the solvent from the solid-content concentrated liquid, a common distillation process or evaporation process can be used in the same as in the case of the ashless coal acquirement step. The solvent which has been separated in the solvent separator 10 is returned to the solvent tank 2, and is used in recycles. By separating the solvent from the solid-content concentrated liquid, a by-product coal mixture containing the by-product coal in which the solvent remains in a proportion of 5 to 10 wt % can be obtained.

(By-Product Coal Drying Step)

The by-product coal drying step is a step of evaporating and separating the remaining solvent from the by-product coal mixture, thereby acquiring the by-product coal. This by-product coal drying step is carried out in the dryer 11 in FIG. 1. The by-product coal mixture which has been obtained in the solvent separator 10 is fed to the dryer 11 and the remaining solvent is evaporated and separated from the by-product coal mixture in the dryer 11. The evaporative separation of the solvent from the by-product coal mixture is preferably carried out in the presence of an inert gas such as nitrogen. In the present embodiment, the dryer 11 is a steam tube dryer which heats, holds and stirs the by-product coal mixture while circulating therein a nitrogen gas as a carrier gas. By separating the remaining solvent from the by-product coal mixture, it is possible to obtain the by-product coal (also referred to as RC, residual coal) in which solvent-insoluble components including ash components have been concentrated.

The by-product coal contains absolutely no moisture though it contains ash components, and has a sufficient calorific value. The by-product coal shows no coal softening and melting properties, but when used as a coal blend, it does not impair the coal softening and melting properties of other kinds of coals included in the coal blend because it has been subjected to elimination of oxygen-containing functional groups. Therefore, this by-product coal can be used as a part of the coal blend for coke-making material similarly to the case of usual non- or slightly-caking coals, and may be also used for various kinds of fuels without being used as a coke-making material. In the present invention, the whole or a part of the by-product coal is used for heating in the extraction step.

The by-product coal is powdery, and its particle diameter (maximum length) is about 0.2 to 1.0 mm. Secondary particles in which particles having a particle diameter (primary particle diameter) of about 0.001 to 0.05 mm have been aggregated are also present in the by-product coal. The particle diameter (secondary particle diameter) of the secondary particles is, for example, about 0.2 to 5.0 mm, although depending on the recovery conditions of the by-product coal. The ash component concentration of the by-product coal is about 10 to 20 mass %, although depending on the kind of the coal, and the amount of moisture in the by-product coal is about 0.00 to 0.20 mass %.

In the present embodiment, the by-product coal which has been obtained in the dryer 11 is humidified by the humidifier 12, and then used for a fuel for the preheater 5. Specifically, the by-product coal is used as a fuel for the preheater 5 by burning the by-product coal at about 1000 to 1400° C. The by-product coal is inferior to an ashless coal, but has high calorie of 6000 kcal/kg or more, and shows higher ignitionability and burnout performance than the coking coal.

The by-product coal obtained by the production process of an ashless coal is generally in a dry state, for example, that the temperature is about 200° C. and the amount of moisture is about 0.00 to 0.20 mass % since the solvent is removed by a distillation process, an evaporation process or the like. For this reason, the by-product coal scatters by wind, and thus, handleability is poor. Therefore, the moisture of the by-product coal is adjusted by the humidifier 12. Specifically, in the humidifier 12, the by-product coal is stirred by a mixer while humidifying the by-product coal by spraying water to the by-product coal. More specifically, the by-product coal is introduced in a mixer, and cooled to a predetermined temperature by pouring water on the by-product coal by a spray, and additionally, moisture and humidity adjustment is performed. The by-product coal thus moisture-adjusted becomes hard to scatter, and handleability as a fuel is improved. In the present embodiment, the water content of the by-product coal is adjusted to 0.1 to 15 wt %. Particles of the by-product coal are pulverized by the stirring with a mixer. Therefore, the particle diameter adjustment can be carried out.

The by-product coal thus moisture-adjusted is fed to the preheater 5, and is used as a fuel for heating a slurry. The by-product coal has high ash component concentration as compared with an ashless coal and a coking coal, and the commercial value as a fuel is inferior to an ashless coal. By using the by-product coal that is produced during the production process of an ashless coal and is more inexpensive than an ashless coal, as a fuel for heating a slurry, fuel cost can be reduced. This enables running cost required in the production of an ashless coal to be reduced. A blend of the by-product coal and a coal may be used as a fuel for heating a slurry.

As described above, the gas generated in the extraction tank 6 can be used in a fuel of the preheater 5 as a supplemental fuel of a by-product coal. This gas alone is insufficient as a fuel for heating a slurry, but has high calorie. Therefore, the gas can be suitably used as a supplemental fuel of a by-product by continuously or intermittently feeing the gas to the preheater 5. Calorie of the by-product coal varies depending on the change of properties such as drying state by the dryer 11, but the by-product coal can be stably burned by burning the gas together with the by-product coal.

The by-product coal mixture obtained in the solvent separator 10 may be used as a fuel for the preheater 5. The by-product coal mixture includes a by-product coal in which a solvent remains in the proportion of 5 to 10 wt %, and can be suitably used as a fuel for the preheater 5.

(Effects)

As described above, in the method for producing an ashless coal according to the present invention, a by-product coal is used as a fuel for heating a slurry which has been obtained in the slurry preparation step. More specifically, a by-product is used as a fuel for preheating a slurry in the extraction step in the preheater 5. The by-product coal is inferior to an ashless coal, but has high calorie, and shows higher ignitionability and burnout performance than the coking coal. However, the by-product coal has high ash component concentration as compared with an ashless coal and a coking coal, and the commercial value as a fuel is inferior to an ashless coal. Therefore, by using the by-product coal that is produced during the production process of an ashless coal and is more inexpensive than an ashless coal, as a fuel for heating a slurry, fuel cost can be reduced. This enables running cost required in the production of an ashless coal to be reduced.

The gas generated in extracting coal components soluble in a solvent in the extraction tank 6 is used as a fuel together with the by-product coal. This gas alone is insufficient as a fuel for heating a slurry, but has high calorie. Therefore, the gas can be suitably used as a supplemental fuel of the by-product. Calorie of the by-product coal varies depending on the change of properties, but the by-product coal can be stably burned by burning the gas together with the by-product coal.

The by-product coal to be used as a fuel has been subjected to moisture adjustment. In general, the by-product coal obtained during the production of an ashless coal is powdery and dried. Such a by-product coal scatters by wind, and handleability is poor. Therefore, by adjusting the moisture of the by-product coal by humidifying the by-product coal such that water content is adjusted to 0.1 to 15 wt %, the by-product coal becomes hard to scatter. This can improve handleability during using the by-product coal as a fuel.

(Modification Examples of Present Embodiment)

Although an exemplary embodiment in the present invention has been described in the foregoing, it merely exemplifies the concrete example and should not be construed as particularly limiting the present invention. The concrete configuration and the like can be modified as appropriate. Further, the actions and effects described in the embodiment in the present invention are merely recited as the most appropriate actions and effects produced in the present invention, and actions and effects which can be achieved by the present invention should not be construed as being limited to those described in the exemplary embodiment in the present invention.

This application is based on Japanese Patent Application No. 2013-069124 filed on Mar. 28, 2013, the entire contents of which are incorporated herein by reference.

INDUSTRIAL APPLICABILITY

According to the present invention, an ashless coal can be produced with the reduced running cost.

DESCRIPTION OF REFERENCE NUMBERS

1: Coal hopper
2: Solvent tank
3: Slurry preparation tank
**3*a***: Stirrer
4: Transport tank
5: Preheater
6: Extraction tank
**6*a***: Stirrer
7: Gravitational settling tank
8: Filter unit
9, 10: Solvent separator
11: Dryer
12: Humidifier
100: Ashless coal production equipment

The invention claimed is:

1. A method for producing an ashless coal, comprising:

a slurry preparation step of mixing a coal and a solvent, thereby acquiring a slurry;

an extraction step of heating the slurry, thereby extracting a coal component soluble in the solvent, wherein a combustible gas is generated in the extraction step;

a separation step of separating the slurry which has been obtained in the extraction step into a solution in which the coal component soluble in the solvent is dissolved and a solid-content concentrated liquid in which a coal component insoluble in the solvent is concentrated;

an ashless coal acquirement step of evaporating and separating the solvent from the solution which has been separated in the separation step, thereby acquiring an ashless coal;

a by-product acquirement step of evaporating and separating the solvent from the solid-content concentrated liquid which has been separated in the separation step, thereby acquiring a by-product coal;

a step of combining the by-product coal as a fuel for heating the slurry with at least a portion of the combustible gas generated in the extraction step, the portion being sufficient to assure stable combustion of the by-product coal; and, wherein the combined by-product coal and portion of the combustible gas generated in the extraction step are combusted to create heat for the slurry which has been obtained in the slurry preparation step.

2. The method for producing an ashless coal according to claim 1, further comprising a step of adding moisture to the by-product coal used as the fuel.

3. The method for producing an ashless coal according to claim 2, wherein the moisture of the by-product coal is adjusted to have a water content of 0.1 to 15 wt %.

* * * * *